United States Patent [19]

Schregenberger

[11] 4,299,036

[45] Nov. 10, 1981

[54] OVEN WITH A MECHANISM FOR CASCADING HEATED GAS SUCCESSIVELY THROUGH SEPARATE ISOLATED CHAMBERS OF THE OVEN

[75] Inventor: Alex J. Schregenberger, Neshanic, N.J.

[73] Assignee: Midland-Ross Corporation, Cleveland, Ohio

[21] Appl. No.: 46,796

[22] Filed: Jun. 8, 1979

[51] Int. Cl.[3] ..... F26B 3/04

[52] U.S. Cl. ..... 34/16; 34/23; 34/48; 34/54; 34/210; 34/216

[58] Field of Search ..... 34/155, 156, 23, 35, 34/86, 210, 212, 216, 76, 77, 48, 54, 34, 15, 16, 31; 432/72, 59

[56] References Cited

U.S. PATENT DOCUMENTS

| | | | |
|---|---|---|---|
| 3,437,321 | 4/1969 | Wilkinson | 34/79 |
| 3,526,968 | 9/1970 | Triplett | 34/48 |
| 3,849,904 | 11/1974 | Villalobos | 34/216 |
| 3,882,612 | 5/1975 | Try et al. | 34/54 |
| 3,892,045 | 7/1975 | Hage et al. | 34/28 |
| 3,923,449 | 12/1975 | Brock | 34/155 |
| 4,133,636 | 1/1979 | Flynn | 432/72 |
| 4,143,471 | 3/1979 | Wochnowski et al. | 34/212 |

*Primary Examiner*—Larry I. Schwartz

*Attorney, Agent, or Firm*—Harlan E. Hummer

[57] ABSTRACT

An oven, having a series of separate and isolated chambers which are horizontally aligned and sealed from each other and the ambient atmosphere and through which a continuous element is passed for treatment by heated gas within the chambers, is disclosed. The oven is provided with means for circulating heated gas to the chamber of the oven last-to-be-encountered by the element and cascading such heated gas successively through the other chambers to the first chamber to be encountered by the traveling element, or in an upstream direction relative to the travel of the element. Thus, the source of heated gas for a particular chamber is from the next succeeding downstream chamber which is contrary to present day ovens wherein each chamber is normally supplied with its own burner system for separately temperature conditioning gas circulated to that particular chamber.

20 Claims, 3 Drawing Figures

OVEN WITH A MECHANISM FOR CASCADING HEATED GAS SUCCESSIVELY THROUGH SEPARATE ISOLATED CHAMBERS OF THE OVEN

BACKGROUND OF THE INVENTION

The invention is applicable to any oven and, in particular, to a strip floater oven which is used in conjunction with a device for applying some type of coating, e.g. paint, to a continuous element, such as a sheet of metal. An oven of this type generally comprises a number of horizontally aligned chambers which are disposed side-by-side and sealed from each other and the ambient atmosphere. A sheet of metal is guided horizontally through the coating device and then successively through the individual heat treatment chambers where it is contacted with heated gases to dry and cure the coating of paint by removal of the paint carrying solvent as a highly volatile vapor in the heated gases exhausted from the various chambers. The heated gases are impinged upon the traveling sheet of metal in each of the heat treatment chambers from a number of nozzles which are positioned vertically above and below the sheet of metal and which are normally at least coextensive with the width of the sheet of metal. At present, heated gases are brought to, and exhausted from, the individual chambers of the oven in much the manner taught, for example, by U.S. Pat. No. 3,923,449. Generally, each treatment chamber is provided with its own system for temperature and other conditioning of the heated gas circulated to that particular chamber. Spent gas including solvent vapor, is removed from the chambers in a common exhaust flue. The volume of gas exhausted from the oven is predetermined to maintain the concentration of solvent vapor at or below 25% of its lower explosive limit. Higher solvent vapor concentrations (up to 50% of the L.E.L.) may be used if the solvent vapor concentration of the exhaust gas is continuously monitored. This is done by periodically removing a portion of the exhaust gas from the common flue and measuring it for its solvent content. It can be appreciated that the solvent content of gas in the main exhaust stream is not a true reflection of the actual concentration of solvent vapor in any of the individual chambers. For example, the concentration of solvent vapor may be dangerously high in one chamber, but offset by a low concentration of solvent vapor in another chamber. The invention is directed to a simplified oven which is highly improved from existing ovens, especially as to the system for circulating heated gas to the various chambers.

Briefly stated, the invention is in an oven which essentially comprises a plurality of individual treatment chambers which are adjacently disposed in side-by-side aligned relation, and which are sealed from each other and the ambient atmosphere. Means are provided for guiding a continuous element, such as a sheet of metal, successively through the chambers for contact with heated gas being circulated therein. Means are supplied for circulating to the last treatment chamber to be encountered by the moving element, gas heated to a predetermined temperature. Other means are provided for circulating through the remaining chambers, the gas circulated to the last-to-encounter chamber and for exhausting the spent gas from the first chamber to be encountered by the moving element, so that, in effect, the same heated gas is cascaded successively through the treatment chambers from the last to the first treatment chamber to be encountered by the element as it moves through the composite oven.

Another aspect of the invention is the utilization of the spent, exhaust gas from the oven in the temperature conditioning of new gas that is suitable for circulation to the last-to-encounter chamber, such means including a fume incinerator in which the exhaust gas is heated and a heat exchanger through which the heated exhaust gas is subsequently passed for heating the new cooler gas which is then circulated to the last-to-encounter chamber.

Other aspects of the invention are the means for maintaining the proper temperature of the gas being cascaded through the oven.

DESCRIPTION OF THE DRAWING

The following description of the invention will be better understood by having reference to the drawing, wherein.

DESCRIPTION OF THE INVENTION

Figure 1:
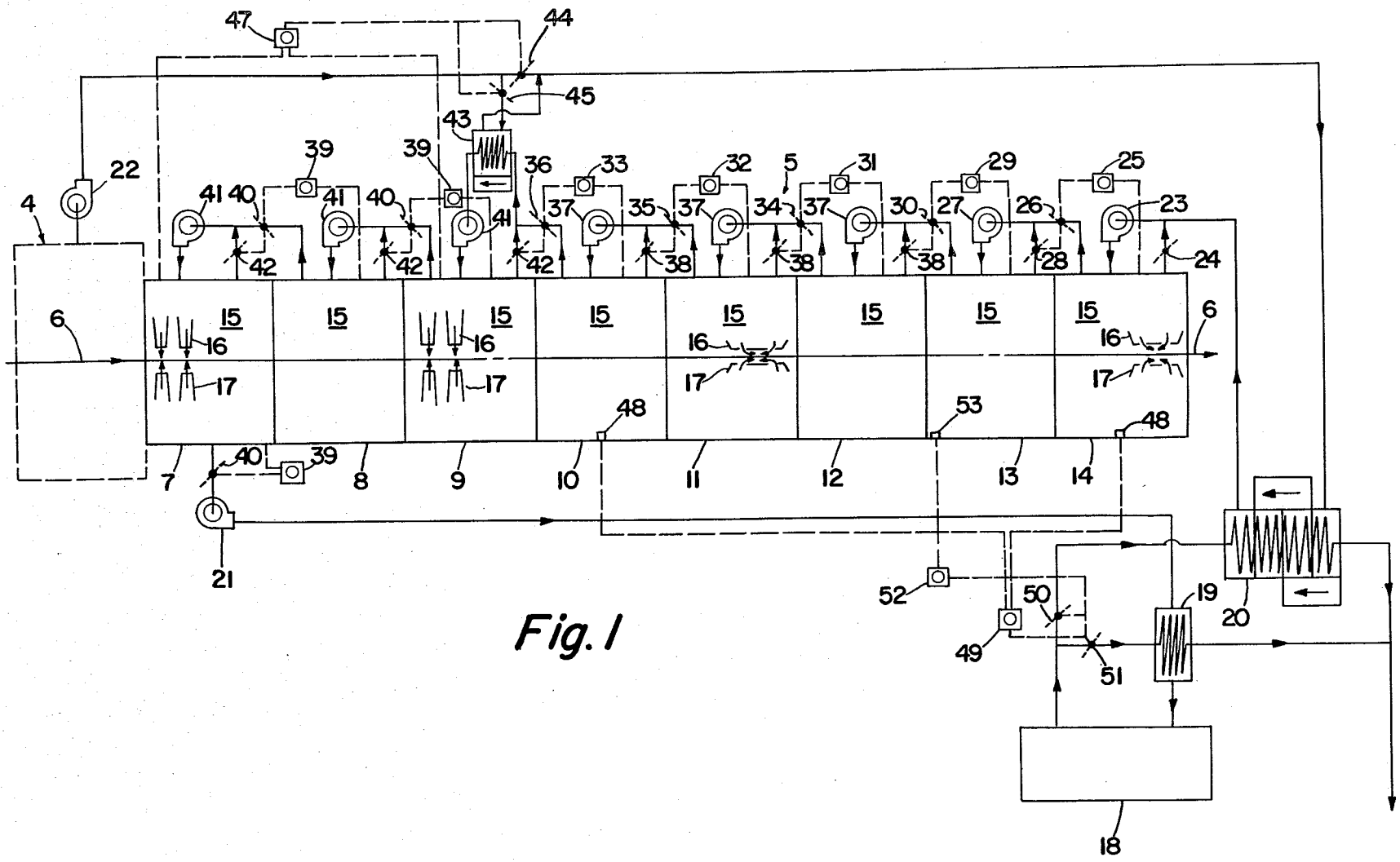
FIG. 1 is a schematic of a coating device and a connecting oven which is made in accordance with the invention.
Figure 1A:
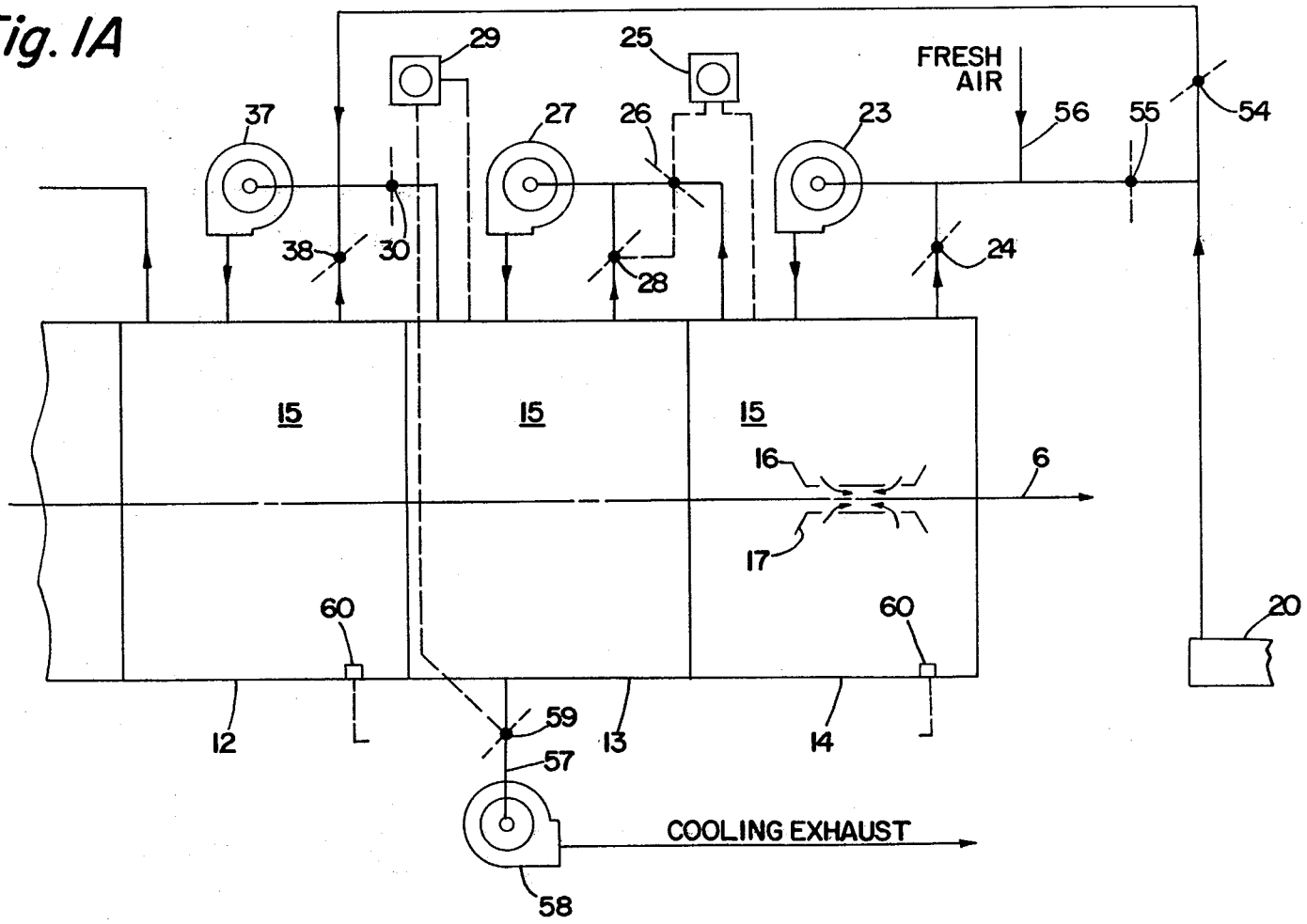
FIG. 1A is a schematic of a portion of the oven of FIG. 1 adapted for cooling an element prior to its exit from the oven.

With reference to FIGS. 1 and 1A, there is shown a conventional coating apparatus 4 with a connecting composite oven 5 through which a continuous element 6, such as a newly painted strip of metal, is passed for treatment, e.g. drying and curing of the paint by removal of the paint carrying solvent as a vapor. The composite oven 5, in this case, essentially comprises a preheat (PH) oven having three (3) adjacent, horizontally aligned zones 7-9 in tandem with a high velocity (HV) oven having five (5) adjacent, horizontally aligned zones 10-14 wherein the heat treatment of the continuous element 6 takes place and with which the invention is primarily concerned. The zones 7-14 each comprise a chamber 15 which is sealed from the ambient atmosphere and the other chambers. The chambers 15 have horizontally aligned openings through which the element 6 enters and exits the various zones 7-14. Conventional seals are provided at these openings to seal the chambers 15 from each other. Two confronting rows of transversely oriented nozzles, e.g. nozzles 16,17, are positioned in each of the chambers 15 of the zones 7-14 for impinging streams of temperature conditioned gas against opposing faces of the continuous element 6 as it is guided horizontally between the two rows of nozzles unsupported by any guide rollers which are normally used to support a traveling element 6. The nozzles in the five zones 10-14 of the HV oven are of the flotation type as described, for example, in U.S. Pat. Nos. 3,837,551 or 3,982,327; whereas the nozzles in the three zones 7-9 of the PH oven are of the direct impingement type as described, for example, in U.S. Pat. No. 2,574,083 wherein air is discharged against the element 6 at an angle of 90° to the plane of the element 6.

A conventional fume incinerator 18, preheat exchanger 19, and makeup heat exchanger 20, are associated with the coating apparatus 4 and composite oven 5.

In operation, a mixture of gas and solvent vapor removed as exhaust gas from the first PH zone 7 which is the most upstream zone of the composite oven 5 to be encountered by the traveling element 6 as it exits the coating apparatus 5, is circulated by a blower 21, under pressure, successively through the preheat exchanger 19 and the fume incinerator 18 where the temperature of the exhaust gas is raised, for example, from 500° F. to 1500° F. The heated exhaust gas is subsequently simultaneously or alternately circulated through the preheat exchanger 19 and/or makeup exchanger 20, depending on the heat requirement in the makeup exchanger 20. The spent heated exhaust gas from the preheat exchanger 19 and/or the makeup exchanger 20, is exhausted to the ambient atmosphere or used, for example, in the temperature conditioning of another fluid.

Any suitable, relatively cool intake air, e.g. air exhausted from the coating apparatus 4 by a blower 22, is circulated through the makeup exchanger 20 into heat exchanging relation with the heated exhaust gas from the fume incinerator 18. This cool intake air is heated in the makeup exchanger 20, for example, from 70°–90° F. to 1040° F. for subsequent circulation to the heat treatment chamber 15 of the fifth or last HV zone 14 which is the most downstream zone of the composite oven 5 to be encountered by the traveling element 6. A blower 23 is utilized to continuously circulate heated gas from the makeup exchanger 20 to the nozzles 16,17 within the chamber 15 of the last HV zone 14. A recirculation damper 24, typical of other such dampers in the composite oven, is provided to permit recirculation of heated gas within the last HV zone 14 to insure a constant flow of gas from the nozzles 16,17 of that zone.

A pressure controlling device 25 monitors the gas pressure within the last HV zone 14 and controls the opening and closing of a flow-control damper 26 which, in turn, regulates the flow of heated exhaust gas from the last HV zone 14 to the next preceding upstream HV zone 13, when the monitored gas pressure exceeds a predetermined level. A blower 27 is operated to circulate, heated exhaust gas from the last HV zone 14 to the nozzles 16,17 within the chamber 15 of the fourth or next-to-last preceding upstream HV zone 13, which is also provided with a recirculation damper 28 that is designed to operate, in unison, with the flow-control damper 26 to permit recirculation of heated gas within the next-to-last HV zone 13 to the nozzles 16,17 of that zone in proportion to a decrease in circulation of gas from the downstream, last zone 14 caused by a partial closing of the flow-control damper 26.

A similar, pressure controlling device 29 is provided to monitor the gas pressure in the fourth HV zone 13 and correspondingly control operation of a damper 30 for regulating the removal of heated gas from that zone to the next preceding upstream third HV zone 12 to be encountered by the traveling element 6. The third HV zone 12 and successively next preceding upstream HV zones 11,10 are similarly provided with pressure controlling devices 31-33 for operating flow-control dampers 34-36 for regulating the circulation of heated gas successively through the third, second, and first HV zones 12,11,10 which are also each provided with similar blowers 37 and recirculation dampers 38 which, as previously described, are used in combination with the flow-control dampers 34-36 to circulate and recirculate heated gas to the nozzles 16,17 within the chambers 15 of these zones which are maintained at successively decreasing temperatures.

The three zones 7-9 of the PH oven are, likewise, each provided with similar pressure controlling devices 39 and associated flow-control dampers 40 for regulating the flow of heated gas from one zone to the next preceding upstream zone, and related blowers 41 and associated recirculation dampers 42, for cascading gas from the HV oven successively through the three zones 9-7 of the PH oven, as previously described in relation to the HV oven. The temperatures of the heated gas cascaded from zone 9 to 8 to 7 are successively decreasing.

A cooling-off exchanger 43 is associated with the blower 41 of the third or last PH zone 9 to be encountered by the traveling element 6. Cool air from any suitable source, such as the coating apparatus 4, is directed by a plurality of dampers 44,45 through the cooling-off exchanger 43 for optionally cooling the heated gas being circulated to the third PH zone 9 from the next succeeding downstream zone which is the first HV zone 10. A temperature controlling device 47 is utilized to sense the temperatures of the heated gas circulating within the first and last PH zones 7,9 and correspondingly control operation of the dampers 44,45 for directing all, or part of the cool air from the coating apparatus 4 through the cooling-off exchanger 43 into heat exchanging relation with the heated gas exhausted from the first HV zone 10, prior to cascading the gas successively through the three PH zones 9-7. The cool air heated in the cooling-off exchanger 43 is subsequently directed to the makeup exchanger 20.

It can be appreciated from a study of the drawing that heated gas from a single source, the makeup exchanger 20, is cascaded successively through the zones 14-7 of the HV and PH ovens, contrary to prior art ovens wherein individual burners are associated with each zone to provide the necessary heat to keep the zones of the ovens at the desired temperatures. The individual burners, normally associated with each heat treatment chamber of prior art ovens for temperature conditioning the gas circulated to the nozzles of that particular chamber, are eliminated, thereby simplifying construction and operation of the composite oven 5 of the invention. It can also be appreciated that the measurement of the concentration of solvent of heated gas in the main exhaust gas stream exiting the first PH zone 7 will reflect the maximum solvent content possible in the composite oven, since the sum of the parts, so to speak, cannot exceed the whole.

The heating of the element in the various zones can be maintained in balance by different methods. One way is to continuously monitor the temperature of the gas being cascaded through the composite oven by periodically sampling the gas in the various zones to determine if the temperature of the gas meets a calculable standard and adjusting the temperature and flow of gas through the composite oven accordingly. However, this is cumbersome and undesireable from the standpoint of being too time consuming. The following unique system was devised for keeping the heating system in balance. A pair of similar devices 48 are provided in the first and last HV zones 10,14 to sense the temperature of the heated gas being circulated within the chambers 15 of these particular zones. The temperature sensing devices 48 are in communication with an appropriate temperature controlling apparatus 49 which controls operation of a pair of dampers 50,51 that are utilized to direct all or a portion of the heated exhaust gas from the fume incinerator 18 simultaneously or alternately through the preheat exchanger 19 and/or the makeup exchanger 20 to control the temperature of the heated intake gas circulated to the last HV zone 14. In essence, the temperature readings of the heated gas in the first and last HV zones 10,14 are translated to an electrical signal. A certain predetermined calculable portion of each electrical signal is combined and compared with a set standard which is also calculable. The positions of the various dampers controlling the temperature and flow of intake air into the composite oven 5 are changed in accordance with any discrepancy or deviation from the standard to bring the heating system back into balance. Another method of maintaining a balanced heating system by controlling operation of the dampers 50,51, is through the use of a similar temperature controller 52 and associated temperature sensing device 53 which is provided at a point that is calculable to produce a constant temperature which is correlated to the temperatures sensed in the first and last HV zones 10,14. Similar controls can be used in the operation of the PH oven.

Cooling Adaption

The fourth and fifth HV zones 13,14 as best seen in FIG. 1A, can be adapted to cool the traveling element 6, prior to exiting the composite oven 5, especially in cases, for example, where three HV zones 10-12 are adequate to remove, for example, the solvent vapor and properly dry and cure the coating on the traveling element 6. The system of FIG. 1A is designed so that heated gas from the makeup exchanger 20 can be alternately circulated to the third and last HV zones 12,14. This is achieved by the use of a pair of dampers 54,55 which are designed to direct heated gas from the makeup exchanger 20 to the third HV zone 12, rather than the last HV zone 14. A fresh air intake 56 is provided to supply cool, fresh air from any suitable source to the last HV zone 14 for cascading through it and the next preceding upstream HV zone 13 from which the cooling gas is exhausted through an outlet fluid passageway 57 by a blower 58 to, for example, the ambient atmosphere. The pressure controlling device 29 communicating with the next-to-last HV zone 13, is utilized to operate and control the positioning of a damper 59 which regulates the exhaust of cool gas through the outlet passageway 57. Temperature sensors 60 in the last and third last zones 14,12 of the HV oven can be used in the same manner as described in relation to sensor 48, to adjust the temperature of the gas used in the cooling operation.

Embodiment with Individual Oven Temperature Controlling Device

Figure 2:
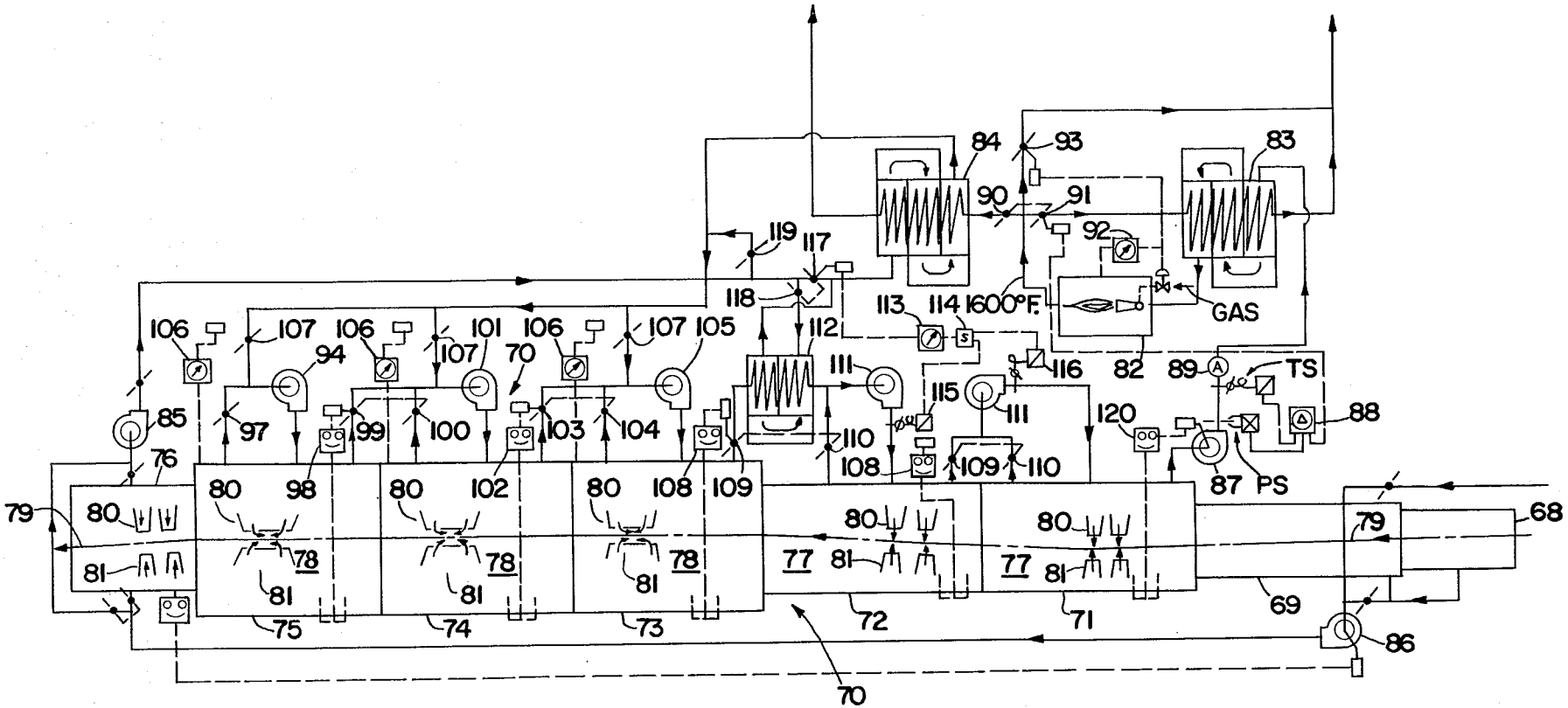
FIG. 2 is a schematic of a coating device and a different connecting oven which also utilizes the invention and is further provided with a unique mechanism for more precisely controlling the temperature of the gas in each of the separate chambers.

With reference to FIG. 2, there is shown a coating apparatus 68 with a connecting flow-out tunnel 69 which is horizontally aligned in abutting relation with a composite oven 70 that comprises a preheat (PH) oven with two (2) zones 71,72 in tandem with a high velocity (HV) oven with three (3) zones 73,74,75 which are horizontally aligned in abutting relation with a tail-end cooling chamber 76. The zones 71,72 and 73-75 of the PH and HV ovens are provided with similar chambers 77,78, which are sealed from the ambient atmosphere and each other by conventional seals that are associated with the openings between the zones 71-75 through which a continuous element 79, such as a strip of metal, passes as it moves through the composite oven 70. The zones 71-75 of the PH and HV ovens and the cooling chamber 76 are each provided with two rows of confronting nozzles, e.g. nozzles 80,81, between which the continuous element 79 is guided as it travels through the composite oven 70 and cooling chamber 76. As previously indicated, the nozzles 80,81 in the PH oven are of the direct impingement type, whereas those in the HV oven and cooling chamber 76 are of the flotation type.

A fume incinerator 82, a preheat exchanger 83 and a makeup heat exchanger 84, like those used with the composite oven 5 of FIG. 1, are associated with the composite oven 70 of FIG. 2, and function in relation thereto in the manner previously described.

In operation, relatively cool intake air from any suitable source, e.g. the end-of-the-line cooling chamber 76, the coating apparatus 68, or a prime oven coater prior to the coating apparatus 68, alone, or in combination with each other, as shown, is circulated by blowers 85,86 through the makeup heat exchanger 84 where the gas is heated to the desired temperature for circulation to the nozzles 80,81 of the last HV zone 75. The heated gas is cascaded successively through the remaining zones to the first zone 71 of the PH oven from which the heated gas is exhausted at a desired mass flow rate which is controlled by a blower 87 working in conjunction with a suitable gas flow control (FC) instrument 88 which is designed to continuously monitor and measure the mass flow of exhaust gas from the composite oven 70 and cause a change in the temperature of gas circulated to the HV oven, if the mass flow of exhaust gas varies from a desired norm.

The composite oven 70 is designed for a certain evaporation rate which is correlated to a desired mass flow of gas that is set up as a norm to achieve the expected vapor concentration. The calculations for accomplishing this are well known. Thus, it becomes a matter of monitoring the mass flow of gas from the composite oven 70 and correspondingly adjusting the mass flow if it deviates from the desired norm. This is achieved by varying the temperature of gas circulated through the composite oven 70. For example, the FC instrument 88 includes a temperature sensing device TS, for monitoring the temperature of the exhaust gas, and a pressure sensing device PS, for measuring the pressure differential of the exhaust gas as it passes through a certain restricted orifice, since the mass flow of exhaust gas is correlated to these two factors which are constantly measured. These measurements are sent to the FC instrument 88 where they are compiled and compared with the norm. If any change from the norm is observed, the FC instrument 88 will react to cause a corresponding change in the temperature of intake gas being circulated to the HV oven to correct to any mass flow deviation from the norm as will be more fully explained later.

The solvent content of the exhausted gaseous mixture is also monitored and analyzed by any suitable mechanism 89 as it flows from the first PH zone 71 for subsequent circulation through the preheat exchanger 83 and the fume incinerator 82 where the gaseous mixture is heated. The exhaust gas circulation system is designed so that all or part of the heated gaseous mixture from the fume incinerator 82 can be simultaneously or alternately circulated to the makeup heat exchanger 84, the preheat exchanger 83, or simply bypassed directly to the ambient atmosphere. In the first two cases, the heated gaseous mixture is exhausted to the ambient atmosphere, after passage through the makeup heat exchanger 84 and/or the preheat exchanger 83. The FC instrument 88 is utilized to control operation of a pair of dampers 90,91 for diverting all or part of the heated exhaust gas from the fume incinerator 82 to the makeup heat exchanger 84, or to the preheat exchanger 83 to correspondingly regulate the temperature of the intake gas circulated to the HV oven. A conventional temperature controlling mechanism 92 is provided to monitor the temperature of the gas within the fume incinerator 82 by modulation of the gas valve thereof and, if the temperature keeps rising with the gas valve in its minimum position, to operate a damper 93 for controlling the bypassing of heated exhaust gas directly to the ambient atmosphere and thus prevent excessive preheating of the gas circulated through the incinerator 82.

Intake air or gas heated to the predetermined desired temperature in the makeup heat exchanger 84, is circulated by a blower 94 to the nozzles 80,81 in the chamber 78 of the last HV zone 75 for impingement against the moving element 79. A recirculation damper 97 is provided to permit removal of heated gas in the last HV zone 75 for recirculation to the nozzles 80,81 to maintain a constant flow of gas to the nozzles as previously described. A suitable pressure controlling device 98 monitors the pressure of the gas within the last HV zone 75 and accordingly operates a pair of dampers 99,100, the first flow control damper 99 controlling the cascading of heated gas from the last HV zone 75 to the second or next preceding upstream HV zone 74 by means of a blower 101, and the second recirculation damper 100 controlling the removal of heated gas from the second HV zone 74 for recirculation to the nozzles 80, 81 thereof to maintain a constant flow of gas from the nozzles.

A similar pressure controlling device 102 is provided for monitoring the pressure of the gas within the second HV zone 74 and correspondingly operating a flow control damper 103 and a recirculation damper 104 which performs the same functions as the previously described pair of dampers 99,100, but in relation to the cascading of heated gas from the second HV zone 74 to the first or next preceding upstream HV zone 73 by means of a conventional blower 105, and the recirculation of gas within the first HV zone 73. It can be appreciated that heated gas is successively cascaded through the various zones of the HV ovens of FIGS. 1,2 in much the same manner. However, the zones 73-75 of the HV oven of FIG. 2 are each further provided with similar temperature controlling mechanisms 106 to sense the temperatures of the gas in these zones and, accordingly, operate similar dampers 107 to permit the supply of new freshly heated gas from the makeup heat exchanger 84 to the nozzles 80,81 so that, for example, the temperatures of the gas in the three HV zones 73-75 can be maintained equal, or at certain desired levels unlike the previously described composite oven 5 of FIG. 1.

Thus, the composite oven 70 of FIG. 2 has the important features of being able to cascade heated gas successively through the heat treatment zones 73-75 of the HV oven while providing the additional control of supplying to any or all of the zones, if necessary, gas heated to the same, higher, or lower temperatures as the heated gas originally supplied to the last HV zone 75, to more precisely control the temperature of the gas in the various zones of the HV oven. In any case, the intake gas used in the process is heated by the same source, contrary to the prior art which utilizes individual burners at each zone to temperature condition the gas circulated to that zone.

Similar pressure controlling devices 108 are provided in the first HV zone 73 and adjacent second PH zone 72 for monitoring the gas pressures therein and correspondingly operating a pair of dampers 109,110 and similar associate blowers 111 to cascade heated gas into the second and first PH zones 72,71.

A cooling off exchanger 112, similar to that of FIG. 1, is provided between the first HV zone 73 and adjacent second PH zone 72 to cool, if necessary, heated gas received from the HV oven for cascading through the PH oven. An appropriate temperature controlling mechanism 113, in combination with a scale 114 and transducers 115,116, are utilized to sense the temperature of the gas entering the PH zones 72,71 and correspondingly operate a pair of dampers 117,118 to regulate the flow of gas from, for example, the end of the line cooling chamber 76 to the quick-cool exchanger 112. A damper 119 is provided to permit cooling, if necessary, of the gas being circulated to the zones 73-75 of the HV oven from the makeup heat exchanger 84. A suitable pressure controlling device 120 is provided to sense the gas pressure within the first PH zone 71 and correspondingly operate the blower 87 which works in conjunction with the flow control instrument 88 to exhaust heated gas from the first PH zone 71 at a predetermined desired mass flow rate which is correlated to the temperature at which heated gas is circulated to the zones 73-75 of the HV oven, as previously explained.

Thus, there has been described a unique composite oven, wherein heated gas, at a predetermined desired temperature, is successively cascaded through a number of adjacently disposed zones without the use of a separate burner in each zone for temperature conditioning gas being circulated to that particular zone. Moreover, novel systems have been described for monitoring the temperature and mass flow of gas cascading through the composite oven and, accordingly, control the temperature of intake gas being circulated to the composite oven. The mechanical and electrical controls for operating the various components of the composite oven of the invention in proper sequence can be of conventional design.

What is claimed is:

1. An oven, comprising:

(a) a plurality of adjacently disposed chambers which are substantially horizontally aligned and sealed from each other and the ambient atmosphere and through which a continuous element is passed for treatment by heated gas therein;

(b) means for circulating to the chamber of the plurality of chambers last to be encountered by the element as it passes through the oven, gas heated to a predetermined temperature, the means including:

(c) a first heat exchanger through which a heated fluid is circulated;

(d) a source of cool gas compared to the heated fluid circulated through the heat exchanger; and (e) means for circulating cool gas from the source through the heat exchanger into heat exchanging relation with the heated fluid to heat the cool gas to a desired temperature for subsequent circulation to the last chamber;

(f) means for cascading the heated gas from the last chamber successively through the remaining chambers of the plurality of chambers in a direction from the last to the first of the plurality of chambers to be encountered by the element as it passes through the oven without reheating said gas, the gas cascading means including:

(g) means for monitoring the gas pressure in each chamber of the plurality of chambers; and (h) means for exhausting gas from a chamber and circulating it to the next preceding upstream chamber, relative to the movement of the element, when the gas pressure in said chamber reaches a predetermined level;

(i) means for exhausting heated gas from the chamber to which the heated gas is last cascaded to.

2. The oven of claim 1, which includes:

(j) means for heating gas, exhausted from the chamber to which the heated gas is last cascaded to, and circulating said gas through the heat exchanger into heat exchanging relation with the comparatively cool gas circulating therethrough.

3. The oven of claim 2, which includes:

(k) a second heat exchanger interposed between the chamber to which the heated gas is last cascaded to and exhausted from and the exhaust gas heating means;

(j) which includes a fume incinerator and means for alternately circulating heated exhaust gas from the incinerator through the heat exchangers.

4. The oven of claim 3, which includes:

(l) means associated with each of the plurality of chambers for recirculating gas, removed from a chamber back to said chamber.

5. The oven of claim 4, which includes:

(m) means associated with each of the plurality of chambers for separately sensing the temperature of heated gas in each of the chambers; and (n) other means associated with each of the plurality of chambers and the gas temperature sensing means thereof and responsive thereto for allowing heated gas to enter an associated chamber.

6. The oven of claim 5, which includes:

(o) means associated with at least the last chamber for alternately circulating to the last chamber, gas which is cool compared to the heated gas normally circulated to the last chamber.

7. The oven of claim 6, which includes:

(p) means for contacting the element with a liquid coating prior to passage through the plurality of chambers.

8. The oven of claim 1, which includes means for sensing the temperature of the gas in the last chamber and the chamber to which the heated gas is last cascaded to and translating the temperatures to separate electrical signals which are combined in a predetermined proportion for comparison with a norm; and means for adjusting the temperature of heated gas circulated to the last chamber when the combined electrical signals vary from the norm.

9. An oven, comprising:

(a) a plurality of adjacently disposed chambers which are substantially horizontally aligned and sealed from each other and the ambient atmosphere and through which a continuous element is passed for treatment by heated gas therein;

(b) means for circulating to the chamber of the plurality of chambers last to be encountered by the element as it passes through the oven, gas heated to a predetermined temperature;

(c) means for cascading the heated gas from the last chamber successively through the remaining chambers of the plurality of chambers in a direction from the last to the first of the plurality of chambers to be encountered by the element as it passes through the oven without reheating said gas;

(d) means for exhausting heated gas from the chamber to which the heated gas is last cascaded to, the means (c) for cascading heated gas including: (I) means for cascading heated gas through the plurality of chambers at a mass flow rate which is correlated to an evaporation rate of a solvent that is carried by the element, and (II) means associated with the means (d) for exhausting heated gas, for continuously monitoring the mass flow of a mixture of heated gas and solvent vapor exhausted from said chamber to which heated gas is last cascaded to, and for adjusting the temperature of gas circulated to at least the last chamber when the mass flow being monitored varies from, a desired norm.

10. An oven designed to evaporate a liquid solvent carried of a coating material at a certain rate which is correlated to the mass flow of heated gas through the oven, characterized by means for monitoring the mass flow of a mixture of gas and solvent vapor exhausted from the oven, and means for adjusting the temperature of heated gas circulated to the oven when the mass flow being monitored varies from a desired norm, the monitoring means including means for monitoring the temperature of the mixture and means for monitoring the pressure differential of a portion of the mixture as it passes through a restricted orifice.

11. An oven designed to evaporate a liquid solvent carrier of a coating material at a certain rate which is correlated to the mass flow of heated gas through the oven, characterized by means for monitoring the mass flow of a mixture of gas and solvent vapor exhausted from the oven, and means for adjusting the temperature of heated gas circulated to the oven when the mass flow being monitored varies from a desired norm to return the mass flow to the desired norm.

12. A composite oven, comprising:

(a) a preheat oven comprising a plurality of adjacently disposed chambers which are substantially horizontally aligned and sealed from each other and the ambient atmosphere, each of the chambers including a pair of confronting rows of nozzles for directing streams of heated gas towards each other at angles of substantially 90° to a plane which is between and parallel to the rows of nozzles;

(b) a high velocity oven disposed in tandem with the preheat oven and comprising a plurality of adjacently disposed chambers which are substantially sealed from each other and the ambient atmosphere and horizontally aligned with the chambers of the preheat oven, each of the chambers of the high velocity oven including a pair of confronting rows of flotation nozzles for directing streams of gas towards each other at acute angles which are substantially less than 90° to a plane that is between and parallel to the rows of nozzles;

(c) means for moving a continuous element successively through the chambers of the preheat and high velocity ovens between the rows of nozzles in the chambers;

(d) means for circulating heated gas to at least a last entry chamber of the high velocity oven to be encountered by the moving element;

(e) means for cascading heated gas from the last entry chamber of the high velocity oven successively through the other chambers of at least the high velocity oven;

(f) means associated with each chamber through which gas is cascaded, for monitoring the gas pressure within that chamber and causing cascading of gas from that chamber into the next preceeding upstream chamber;

(g) means for exhausting heated gas from an exhaust chamber to which heated gas has been cascaded last to;

(h) a first heat exchanger;

(i) means for heating to a desired temperature gas exhausted from the exhaust chamber, prior to circulating to the heat exchanger at least a portion of the gas heated to the desired temperature;

(j) means for circulating through the heat exchanger into heat exchanging relation with heated gas being circulated therethrough from the heating means (i), gas from a source of gas which is substantially cooler and less contaminated than exhaust gas from the exhaust chamber, to heat the cooler gas for circulation at least to the last entry chamber of the high velocity oven;

(k) means associated with each of the chambers of at least the high velocity oven for removing heated gas from a chamber and recirculating it to the nozzles in that chamber to maintain a continuous flow of gas from the nozzles; and (l) means for measuring at least the temperature of heated gas cascading through the chambers, comparing the measurement to a predetermined desired norm, and adjusting the temperature of heated intake gas circulated to at least the last entry chamber of the high velocity oven in accordance with a variation of the measurement from the norm.

13. The composite oven of claim 12, which includes:

(m) a second heat exchanger disposed between the gas heating means (h) and the exhaust chamber;

(n) means for directing exhaust gas from the exhaust chamber through the second heat exchanger into heat exchanging relation with hotter gas circulating therethrough to preheat the exhaust gas, prior to circulation to the gas heating means (h); and (o) means for alternately directing heated gas from the gas heating means (h) to the heat exchangers.

14. The composite oven of claim 13, wherein the gas temperature heating means (k) includes:

(I) means for measuring the temperature of gas in the last entry chamber and the exhaust chamber and translating each said measurement to an electrical signal, and combining said signals in a predetermined proportion for comparison with a predetermined norm.

15. The composite oven of claim 13, which includes:

(p) means interposed between the preheat and high velocity ovens for alternately cooling heated gas cascaded from the high velocity oven through the preheat oven.

16. The composite oven of claim 15, which is designed to evaporate a solvent carrier of a coating for the element at a certain rate which is correlated to the mass flow of heated gas cascaded through the chambers, the gas temperature measuring means (k) including:

(I) means for monitoring the mass flow of exhaust gas and solvent vapor from the exhaust chamber, including:

(i) means for monitoring the temperature of the mass flow of exhaust gas and solvent vapor; and (ii) means for monitoring the gas pressure differential of the mass flow of exhaust gas and solvent vapor as it passes through a restricted orifice; and (II) means coacting with the mass flow monitoring means for adjusting the temperature of intake gas circulated to each of the chambers of the high velocity oven when at least the temperature of gas measured varies from a desired norm.

17. The composite oven of claim 16, which includes:

(q) means for coating the element with a coating carrying solvent, prior to passage of the element through the preheat oven.

18. The composite oven of claim 17, which includes:

(r) means at the tail end of the high velocity oven for cooling the element, prior to passage into the ambient atmosphere.

19. A method of heat treating a continuous element as it successively travels substantially horizontally through a plurality of adjacent, aligned chambers which are substantially sealed from each other and the ambient atmosphere, comprising:

(a) heating gas, used in the heat treatment of the element, outside the chambers;

(b) cascading such heated gas successively through the plurality of chambers in a direction from the last to the first of the plurality of chambers to be encountered by the traveling element without reheating such gas;

(c) cascading such heated gas through the chambers at a mass flow rate which is correlated to a desired rate of evaporation of solvent carried by the element into the chambers;

(d) monitoring the mass flow rate of gas exhausted from the chamber to which the heated gas is last cascaded to; and (e) adjusting the temperature of the heated gas cascading through the chambers, when the mass flow rate of exhausted gas varies from a predetermined mass flow rate.

20. The method of claim 19, which includes:

(f) monitoring the temperatures of heated gas in the last and first of the plurality of chambers to be encountered by the traveling element;

(g) translating each measured temperature of heated gas in the last and first chambers into an electrical signal;

(h) combining the electrical signals of the last and first chambers in a predetermined proportion for comparison with a norm which is correlated to desired temperature of gas to be maintained in the chambers; and (i) adjusting the temperature of gas cascading through the chambers, when the combined signal differs from the norm.

* * * * *